United States Patent [19]

McCrory

[11] Patent Number: 4,462,331

[45] Date of Patent: Jul. 31, 1984

[54] INFLATABLE BOTTOM CONSTRUCTION FOR INFLATABLE BOAT

[75] Inventor: William M. McCrory, Panama City, Fla.

[73] Assignee: The United States of America as represented by the Secretary of the Navy, Washington, D.C.

[21] Appl. No.: 462,642

[22] Filed: Jan. 31, 1983

[51] Int. Cl.[3] ..... B63B 7/08

[52] U.S. Cl. ..... 114/345; 441/40

[58] Field of Search ..... 114/345; 441/40, 41, 441/129, 66; 52/2; 5/449, 455, 456, 457

[56] References Cited

U.S. PATENT DOCUMENTS

| | | | |
|---|---|---|---|
| 2,743,510 | 5/1956 | Mauney et al. | 28/74 |
| 2,850,252 | 9/1958 | Ford | 244/114 |
| 3,056,980 | 10/1962 | Holladay | 9/310 |
| 3,425,071 | 2/1969 | Frieder et al. | 9/11 |
| 3,931,655 | 1/1976 | Luscombe | 9/2 A |
| 4,251,893 | 2/1981 | McCrory et al. | 9/11 A |

*Primary Examiner*—Sherman D. Basinger

*Attorney, Agent, or Firm*—Robert F. Beers; Harvey A. David

[57] ABSTRACT

An inflatable bottom structure in an inflatable boat avoids blisters in the exposed, heavy duty outer walls of superimposed upper and lower inflatable floors by a composite wall construction wherein an outer layer of synthetic rubber material, in which a heavy woven synthetic fiber fabric is embedded, and an inner synthetic rubber layer, disposed on a flexible tension strand holding scrim cloth layer, are fused and cured into a unitary wall.

2 Claims, 1 Drawing Figure

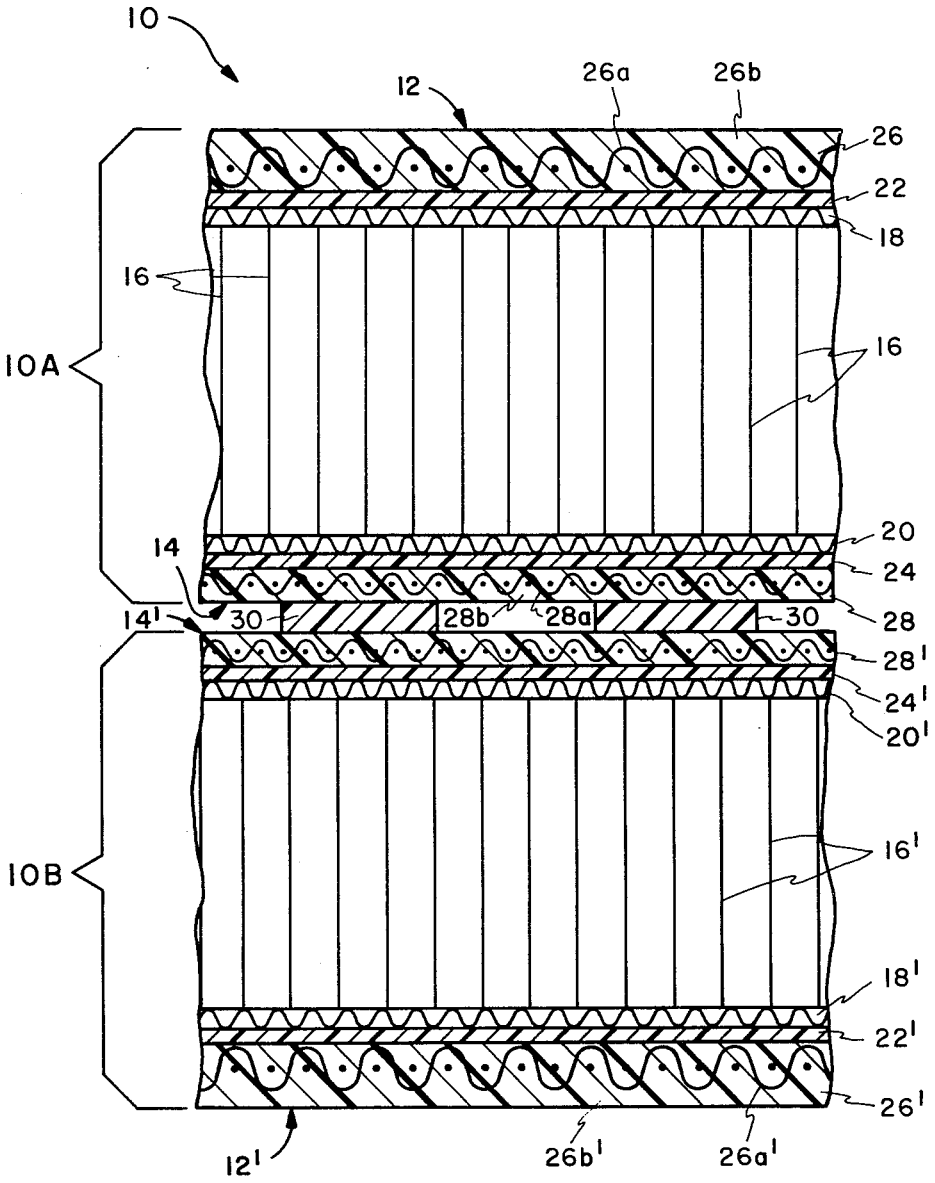
10
12
26a
26b
26
22
18
16
10A
16
20
14
24
14'
30
28b
28a
30
28
28'
24'
20'
10B
16'
18'
22'
26'
12'
26b'
26a'

INFLATABLE BOTTOM CONSTRUCTION FOR INFLATABLE BOAT

BACKGROUND OF THE INVENTION

This invention relates to inflatable boats, and more particularly to such craft capable of being driven at high speeds by an engine such as an outboard motor.

A wide variety of collapsible and inflatable boats have been known for thier virtues of compact storage when not in use, lightness in weight, and large measure of buoyancy. Those virtues have made such craft suitable for use as life boats, work boats that can be carried to places of use under circumstances that would be difficult to transport rigid boats, and for a variety of recreational uses.

One of the limitations characteristic of inflatable boats has been that the powering thereof by outboard motors of sufficient size to achieve planning speeds has met with only limited success. This is generally due to the inherently flexible nature of the craft, and particularly of the bottom or floor thereof which has a tendency to conform to the shape of the wave generated by the hull during movement through the water.

U.S. Pat. No. 4,251,893 discloses an inflatable boat, especially, suited for high speed use, wherein the floor structure or hull bottom comprises two superimposed upper and lower mat-like inflatable floors that, together with a rigid keelson, provide adequate rigidity for high speed planing operation without the need for floor boards for adding stiffness. The upper and lower inflatable floors or mats each comprise spaced top and bottom fabric walls that are interconnected by a multiplicity of flexible threads or drop-stitches of uniform length that serve as tension members to limit the spacing between the top and bottom walls when air is contained therebetween at greater than atmospheric pressure.

The exposed top and bottom farbric walls of each inflatable floor or mat have been built-up of multiple layers including an inner scrim layer to which the drop-stitches are attached, a first solid sealer adhesive layer, a lightweight chafer layer of nylon or other woven synthetic fabric that is coated and impregnated with a rubber or rubber-like material such as neoprene, a second solid sealer adhesive layer, and a heavy duty chafer layer of synthetic fiber fabric coated and/or impregnated with rubber or synthetic rubber material.

That construction has been subject to the formation of air blisters between the inner lightweight rubberized fabric layer and the outer, heavy duty, wear and scuff resistant rubberized layer. These blisters are formed by otherwise insignificant permeation of inflating air passing outwardly through the inner layer of sealing material, and trapped by the second layer of sealing material and/or the heavy duty chafer layer. The air blister formation is characterized by partial separation of layers and the appearance of substantial bulges in the exposed surfaces of the floor. These blisters are not only unsightly but also, when occurring on the hull bottom, impair waterflow and the high speed planing characteristics of the boat.

SUMMARY OF THE INVENTION

With the foregoing in mind, it is a principal object of this invention to provide an improved inflatable bottom or floor structure for inflatable boats that avoids the formation of air blisters while retaining the durability, rigidity, and shape retaining qualities desired for use under severe operating conditions including high speed operation.

Another object of the invention is the provision of an inflatable boat bottom structure that is characterized by improved flexibility when deflated wth concomitant improvement in ease of furling into a small package.

Still another object is to attain the foregoing objects and advantages while simplifying manufacturing operations and costs.

Other objects and many of the attendant advantages will be readily appreciated as the subject invention becomes better understood by reference to the following detailed description, when considered in conjunction with the accompanying drawings.

DESCRIPTION OF THE DRAWINGS

The sole FIGURE is a vertical sectional view illustrating an improved inflatable boat floor structure embodying the invention.

DESCRIPTION OF THE PREFERRED EMBODIMENT

Referring to the sole FIGURE, an exemplary inflatable boat bottom construction embodying the invention is indicated generally at 10 and comprises superimposed upper and lower inflatable floor elements 10A and 10B, respectively. These floor elements are of similar construction, but floor element 10B is inverted relative to floor element 10A.

The inflatable floor element 10A comprises spaced upper and lower, or top and bottom, rubberized fabric walls 12 and 14, respectively, which walls are substantially air impervious and distinguished additionally in that wall 12 is characterized as being a heavy duty wall and is relatively thick compared to wall 14. Conversely, wall 14 is characterized as being a light duty wall and is relatively thin compared to wall 12. The walls 12 and 14 are interconnected by a multiplicity of flexible strands or threads 16 of substantially equal length that act as tension elements to limit the spacing of the upper and lower walls of the floor element when inflated.

The walls 12 and 14 comprise inner scrim cloth layers 18 and 20, respectively, through which the drop-stitches 16 are formed. Disposed outwardly of the drop-stitch supporting scrim cloth layers 18 and 20 are layers 22 and 24, respectively, of synthetic rubber, such as neoprene, that serves as an adhesive for uniting the scrim layers to outer air impervious and wear or scuff resistant layers 26,28 about to be described. Thus, outside of the adhesive rubber layers 22, 24, respectively, are a thick, heavy duty scuff or strength layer 26 and a thinner, light duty scuff or strength layer 28. The thicker layer 26 comprises a tightly woven nylon or other synthetic fiber fabric **26*a* impregnated and coated with, or embedded in, a substantially air impervious rubber or rubberlike material 26*b*. In the heavy duty layer 26, of the present example for the stated boat floor purpose, the fabric 26*a* is 840 denier nylon fiber, 5 oz per yard before coating. The fabric 28*a* of the light duty layer 28** is a considerably finer denier and lighter fabric.

During manufacture, the adhesive layers 22,24 are applied as an uncured neoprene coating to the scrim layers 18 and 20, followed by direct application of neoprene coated and impregnated nylon layers 26,28 in uncured state. The thus assembled materials are placed in an autoclave and subjected to heat and pressure typical in the art for curing neoprene coated nylon or the like.

The resulting composite construction 10A is characterized by fusing of the neoprene adhesive layer 22 with the rubber or rubber-like material **26*b* of the heavy duty scuff layer 26 throughout the length and breadth of its extent, in effect uniting the cured adhesive layer and air impervious layer into a unified, integral mass or layer resulting in a heavy duty wall 12 that has no remaining lamination interfaces. It is this characteristic that precludes any likelihood of separation and blister formation that has been experienced in prior constructions wherein the heavy duty layer is achieved by laminating a second rubberized fabric layer to an existing rubberized fabric layer. The adhesive layer 24 and rubber layer 28** are similarly fused into an integral mass.

The inflatable floor element 10B comprises parts corresponding to the described parts of element 10A designated by corresponding reference numerals with prime marks added, it being recalled that the thicker, heavy duty wall structure is at the bottom of the element 10B.

The inflatable elements 10A and **10*b* are united in the boat bottom structure 10 by strips of adhesive material 30**, the strips conveniently being in parallel spaced relation.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. In an inflatable boat bottom structure of the type including a first inflatable floor element in superimposed relation on a second inflatable floor element, said floors each comprising upper and lower rubberized fabric walls interconnected by a multiplicity of drop-stitches as tension elements, the improvement comprising:

each of said walls comprising an inner scrim layer carrying said drop-stitches;

an inner synthetic rubber adhesive layer disposed on said scrim layer;

an outer layer of woven strength fabric;

an outer synthetic rubber layer in which said strength fabric is embedded;

said outer and inner synthetic rubber layers being fused and cured into a single integral layer free of lamination interfaces; and said upper fabric wall of said first inflatable floor and said lower fabric wall of said second floor each being of greater thickness and having heavier strength fabrics than do the lower fabric wall of said first floor and the upper fabric wall of said second floor.

2. In an inflatable boat bottom structure as defined in claim 1, said first and second floors being bonded together in said superimposed relation by laterally spaced strips of adhesive disposed between the lower wall of the first floor and the upper wall of the second floor.

* * * * *